United States Patent [19]

Owen

[11] Patent Number: 4,726,775

[45] Date of Patent: Feb. 23, 1988

[54] ELECTRICAL CONNECTOR AND CIRCUIT BOARD COMBINATION

[75] Inventor: Leonard J. Owen, Watford, England

[73] Assignee: AMP Incorporated, Harrisburg, Pa.

[21] Appl. No.: 43,910

[22] Filed: Apr. 29, 1987

[51] Int. Cl.[4] ..... H01R 11/03

[52] U.S. Cl. ..... 439/49; 439/630

[58] Field of Search ..... 439/43, 49, 50, 51, 439/53, 630, 632

[56] References Cited

U.S. PATENT DOCUMENTS

| | | | |
|---|---|---|---|
| 4,094,566 | 6/1978 | Dola et al. | 339/14 R |
| 4,191,441 | 3/1980 | Ryder et al. | 339/17 F |
| 4,504,102 | 3/1985 | Wakuluk | 439/43 |
| 4,545,635 | 10/1985 | Bunnell | 439/49 |

*Primary Examiner*—Joseph H. McGlynn

*Attorney, Agent, or Firm*—Thomas G. Terrell

[57] ABSTRACT

A module (2) is connected to a multiplexing system by means of a printed circuit board (18) having thereon first conductors (14) each connected to a second conductor (22) by means of a spring clip (24) on the board (18). An edge connector (38) for mating with the board (18) has thereon projections (62) which can be selectively removed before the connector (38) is mated with the board (18). When the board (18) and the connector (38) are mated, the remaining projections (62) each left a respective clip (24) from its first conductor (14) and protrude between the clip (24) and the first conductor (14), thereby disconnecting them. The projections (62) and clips (24) thus provide a switching system which can be used to ensure that only selected second conductors (22) carry current.

6 Claims, 6 Drawing Figures

ELECTRICAL CONNECTOR AND CIRCUIT BOARD COMBINATION

This invention relates to a combination between an electrical connector and a circuit board for mating therewith.

The invention has particular application to modular systems comprising modules which must be selectively connected to electrical supply leads. For example, supply leads for a multiplexing system.

According to the invention a module is connected to the system by means of a printed circuit board having thereon first conductors, each of which is electrically connected to an associated second conductor by means of a spring clip on the board, selected ones of the spring clips being arranged to be disconnected from their first conductors by means on a circuit board edge connector which is matable with the circuit board of the module. The disconnecting means comprise projections on the edge connector which can be selectively removed before the connector and the board are mated. When the connector is being mated with the circuit board, the remaining projections each lift a respective clip from its first conductor and protrude between the clip and the first conductor in the mated condition of the edge connector and the circuit board. The projections, therefore, provide a switching system which can be utilized to ensure that current is supplied only to selected ones of the second conductors when the edge connector has been mated with the circuit board.

For a better understanding of the invention, reference will now be made by way of example, to the accompanying drawings in which.

Figure 1:
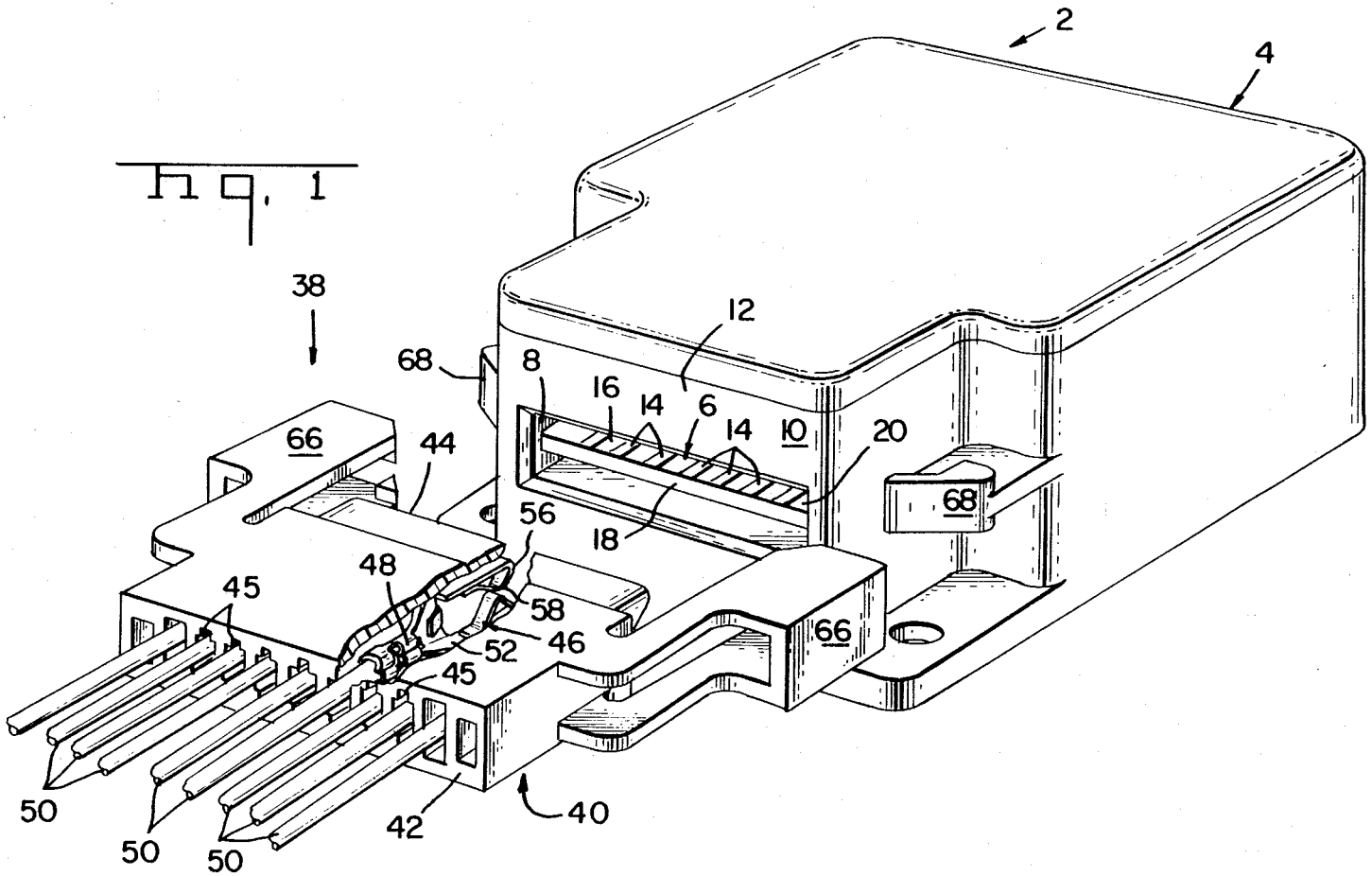
FIG. 1 is an isometric view, with part broken away, of a printed circuit edge connector positioned for mating with an electrical module.
Figure 2:
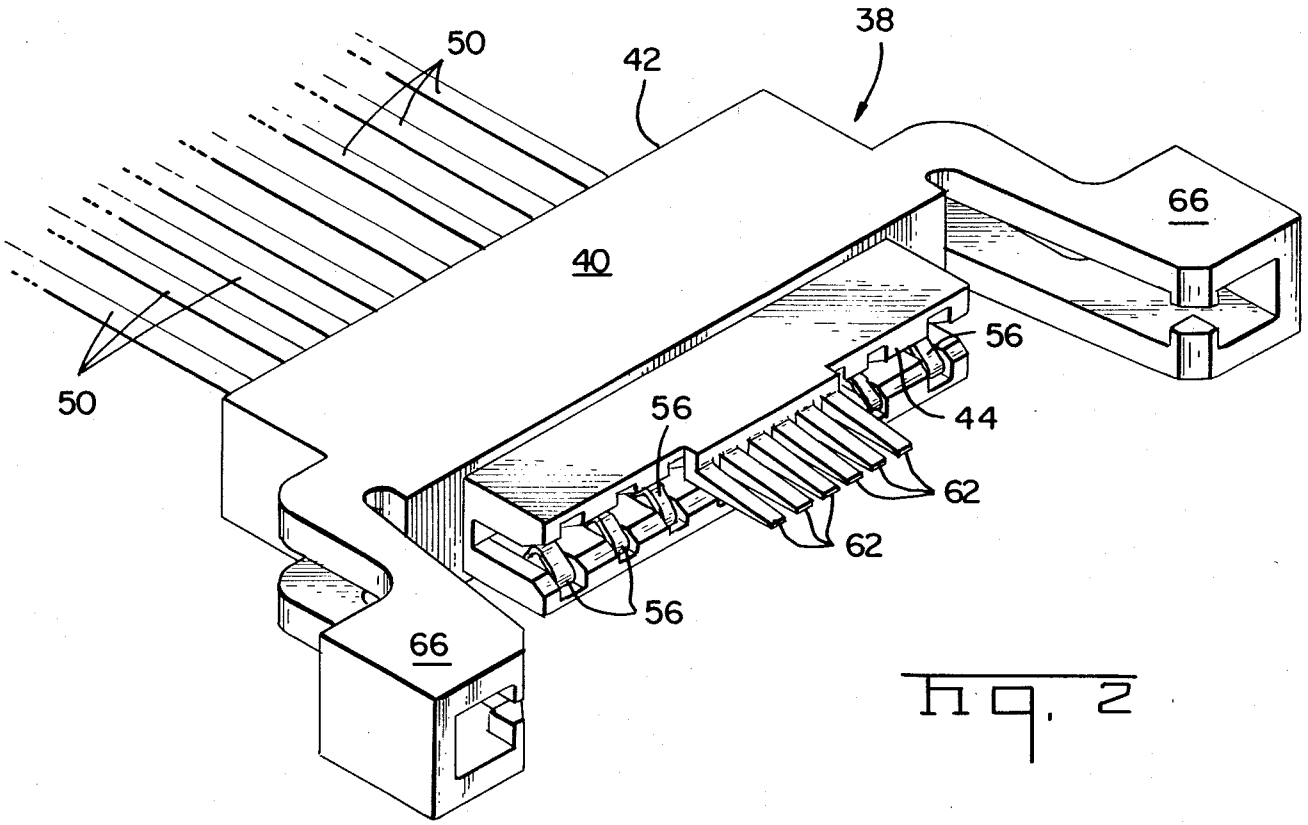
FIG. 2 is an isometric view of the edge connector taken from the front thereof.

An electrical module 2 comprises an insulating housing 4 supporting a printed circuit board 6 therein in an opening 8 in the forward wall 10 of the housing 4, which defines a forward, mating face 12 thereof. The board 6 has on its upper face 16 a row of six parallel printed conductors 14, extending from the forward edge 18 of a mating edge portion 20 of the board 6, back from the edge 18, and terminating at a short distance back from the edge portion 20 (FIGS. 3 to 6). The board 6 also has on its face 16, a row of second printed conductors 22, each in longitudinal alignment with an associated one of the conductors 14, but being spaced therefrom. Each conductor 22 is electrically connected to the associated conductor 14 by means of a spring clip 24 having a first end 26 secured to the board 6 and thus to the conductor 22, by means of a rivet 28. Each clip 24 has a second, and opposite, end 30 which is spaced from the associated conductor 14, and back from said end 30, a contact portion 32 which is bowed towards the associated conductor 14 and has a contact surface 34 which is pressed resiliently against the conductor 14 by virtue of the spring action of the clip 24. Between the contact portion 32 and the rivet 28, the spring has a portion 36 which is bowed away from the board 16 and which is the active spring portion of the clip 24. The conductors 22 are connected to further conductors (not shown) of a multiplexing system, of which the module 2 is one of many other similar modules, for selectively connecting components of a motor vehicle, for example lamps for various purposes, to current.

A printed circuit board electrical edge connector 38 for mating with the module 2, comprises an insulating housing 40 having a mating face 42 and a wire receiving face 44. A series of terminal receiving, through, cavities 45 formed in the housing 40, and extending between the wire receiving face 42 and the mating face 44, each receive an electrical terminal 46 having a wire connecting portion 48, electrically connected to an insulated electrical wire 50, a transition portion 52, having a locking tongue 54 by means of which the terminal is locked in its cavity, and extending from the transition portion 52, a pair of opposed contact springs 56 each having a contact surface 58 protruding into a board edge receiving channel 60 in the mating face 44.

Figure 4:
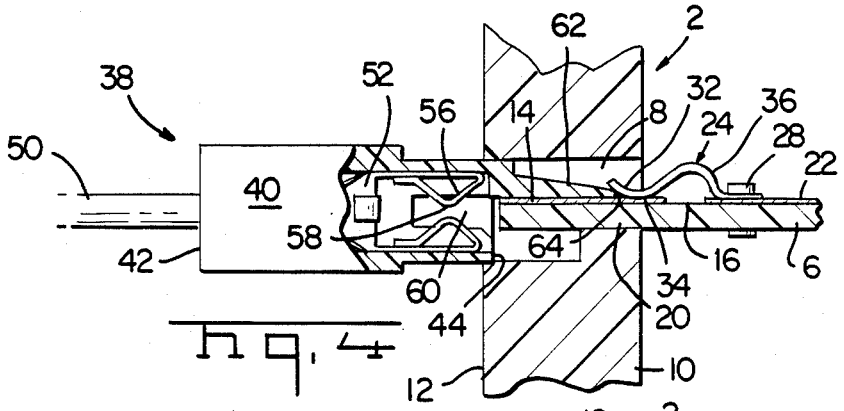

The edge connector 38 can be mated with the board 6 by advancing the connector 40 with its mating face 44 leading, in a mating direction, indicated by the arrow A in FIG. 4, into the opening 8, so that the edge portion 20 of the board 6 is received in the board slot 60 whereby the contact surfaces 58 of six of the upper contact springs 60 each make firm, resilient electrical contact with a respective one of the conductors 14. The remaining terminals 46 make contact with other printed conductors on the board 6.

Figure 3:
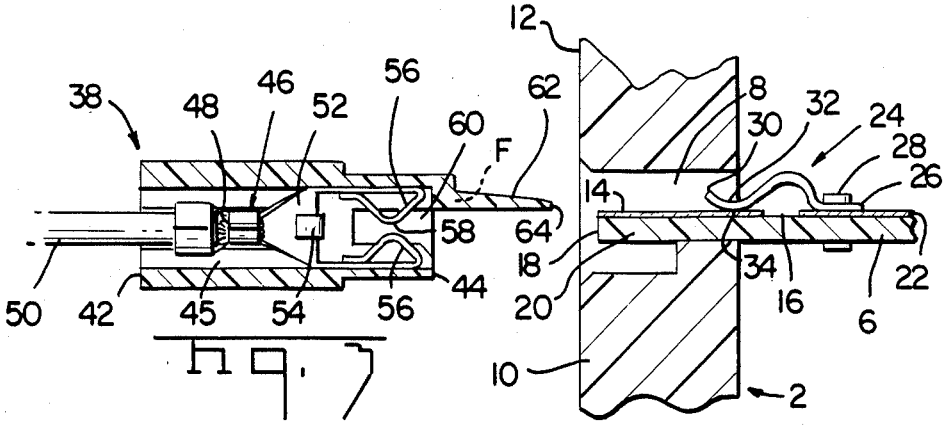
FIGS. 3 to 5 are fragmentary sectional views illustrating successive stages in the mating of the edge connector with the module.
Figure 5:
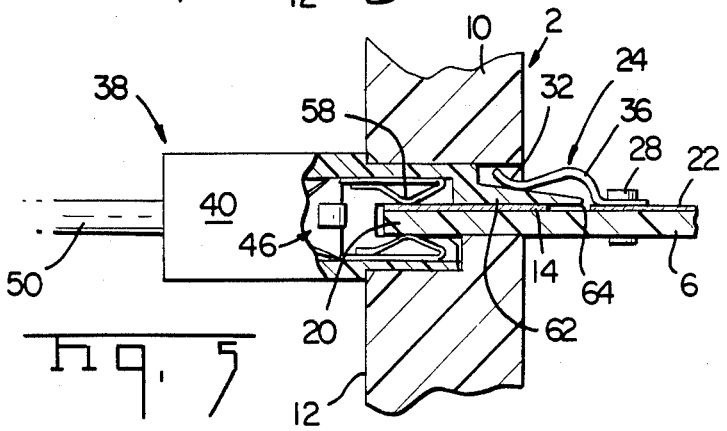
Figure 6:
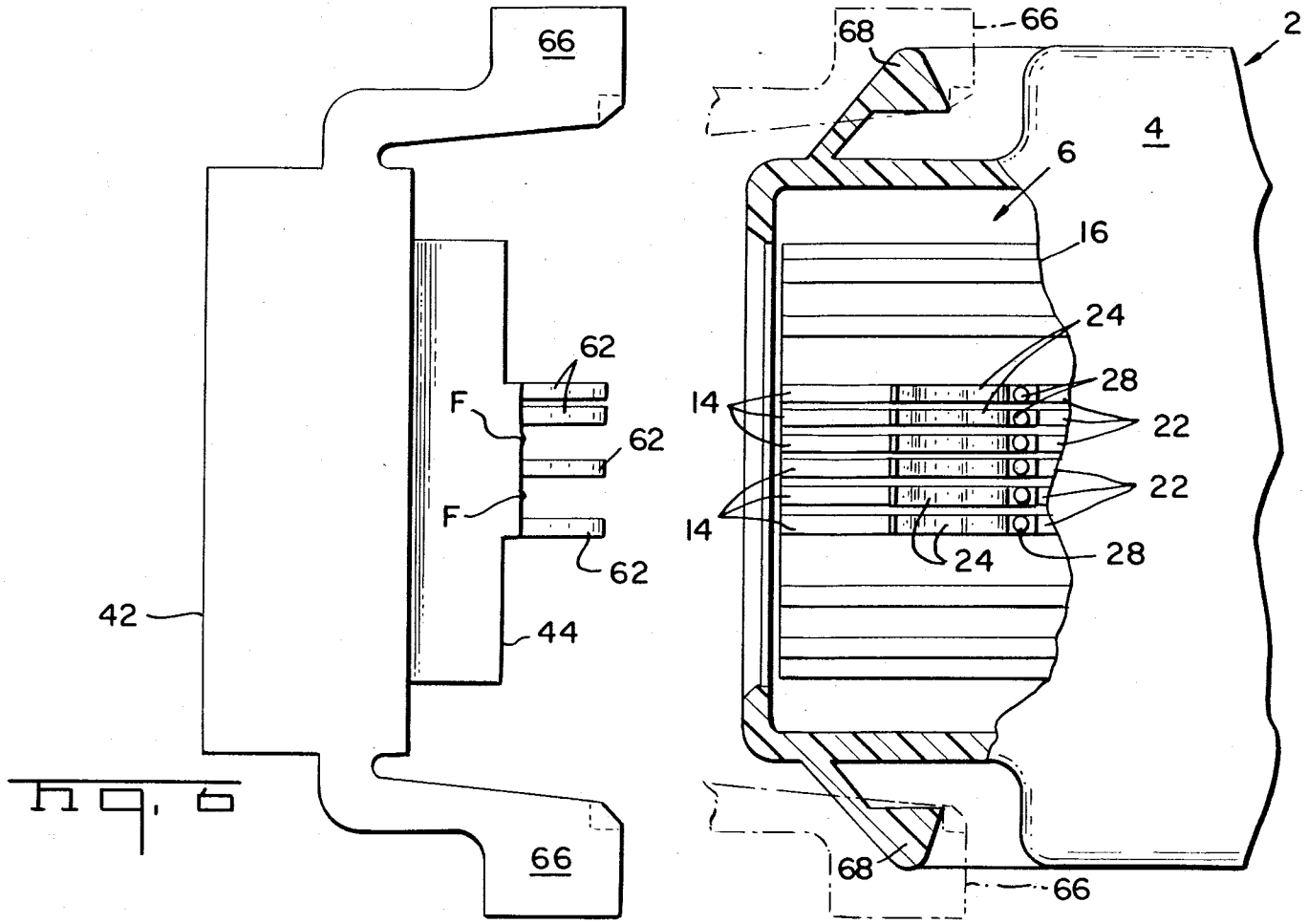
FIG. 6 is a plan view with part broken away showing the edge connector positioned for mating with the module.

For the selective connection to current of the conductors 22 by way of the wires 50, there extends from the mating face 44 of the housing 40, a row of frangible, parallel switching projections 62, each of which is wedge shaped and thus tapers in longitudinal section away from the face 44, as shown in FIGS. 3 to 5. Each projection 62 can be broken away from the housing 40 along a fracture line F to remove it therefrom. Before mating the connector 38 with the board 6, selected ones of the projections 62 are broken off, as shown in FIG. 6. When the connector 38 and board 6 are mated, each remaining switching projection 62 slides along the respective conductor 14 so that the tip 64 of the projection 62 engages beneath the free end 30 of the associated spring clip 24, as shown in FIG. 4, and as the connector 38 is being advanced in the mating direction A to its fully mated position, the projection 62 cams the clip 24 away from the board 6 and protrudes between the conductor 14 and the contact surface 34 of the clip 24, thereby electrically disconnecting the conductor 14 from its associated conductor 22. At the positions where the projections 62 have been removed from the housing 40, the clips 24 remain in contact with their associated conductors 14, so that the circuits of the conductors 22 remain unbroken. Different ones of the projections 62 are, of course, broken away in respect of the connectors to be mated with each of the modules of the multiplexing system.

The upper and lower walls of the opening 8 are spaced to an extent to guide the connector 38 during its insertion into the opening 8.

The connector 38 is secured in mating relationship with the module 2 when the former has been mated with the board edge portion 20, by means of latch arms 66 on the connector 38 which engage with latching projections 68 on the housing 4 of the module 2.

I claim:

1. In combination, an electrical connector and a circuit board for mating therewith, the connector comprising an insulating housing containing a row of electrical terminals each having a contact spring for engaging an individual conductor of a row of first conductors on the circuit board, as the connector is mated therewith in a mating direction, each first conductor being electrically connected to an associated second conductor on the board by means of a spring element on the board, said housing being provided with a row of selectively removable projections extending therefrom in the mating direction each for engaging a respective one of said spring elements, as the connector and the circuit board are being mated, electrically to disconnect associated first and second conductors connected by the spring element, whereby the associated first and second conductors can be selectively electrically disconnected by mating the connector and the board, by removing selected ones of said projections before the connector and the circuit board are mated.

2. The combination claimed in claim 1, wherein said connector has a slot for receiving an edge of the circuit board to engage said contact springs with said first conductors, each first conductor extending along the circuit board to a position proximate to said edge thereof, each spring element having a first end secured to the respective second conductor and a second end which presses resiliently against the associated first conductor at a position back from said edge of the board, each projection of the housing, being wedge shaped, for interposition between the second end of the respective spring element and the associated first conductor against which it pressed, as the connector and the board are being mated.

3. The combination claimed in claim 2, wherein the second end of each spring element is bowed towards the respective first conductor and has a free end directed towards said edge of the board and being spaced from the board.

4. In combination, a printed circuit board edge electrical connector and a printed circuit board for mating therewith, the connector comprising an insulating housing having a mating face into which extends a slot for receiving an edge portion of the board, and containing a row of electrical terminals each having a portion for connection to an electrical lead, and a contact spring having a contact surface projecting into the board receiving slot, the circuit board having on one side thereof a row of first printed conductors thereon each extending from a position proximate to said edge of the board, back from said edge, to make electrical contact with a respective one of said contact surfaces, when said edge of the board has been inserted into said slot, the board also having on the same side thereof as the row of first conductors, a series of second printed conductors each spaced from, but being adjacent to, an associated one of said first conductors, a spring clip secured to each second conductor, having a contact surface resiliently engaged with the associated first conductor, electrically to connect it thereto, said spring clip having a free end portion projecting beyond said contact surface thereof towards said edge of the board and being spaced from said board, said housing having a row of frangible, wedge shaped projections each extending from the mating face of the housing in alignment with one of said contact springs, for engaging between the contact surface of a respective one of said spring clips and the associated first conductor, when said edge portion of the board has been inserted into the channel, whereby by breaking away selected ones of said projections, before the connector and the board are mated, the electrical connections between selected ones of said first and second conductors can be broken as a result of said edge portion of the board being inserted into said board receiving slot of the housing.

5. The combination claimed in claim 4, wherein the contact surface of each spring clip is bowed towards the associated first conductor, the spring clip being bowed away from the board between its contact surface and its connection with the respective second conductor.

6. The combination claimed in claim 4, wherein the circuit board is supported in an opening in a bulkhead in an electrical connector module, with said edge portion of said board being free for reception in the board slot of the housing upon insertion of the connector into the opening with said mating face thereof leading, opposed walls fo the opening facing opposite sides of said edge portion of the board, being spaced from one another to an extent to guide the connector during its insertion into the opening, so that each remaining frangible projection thereof engages between the contact surface of the respective spring clip and the respective first conductor of the board.

* * * * *